US008151836B2

(12) United States Patent
Walton et al.

(10) Patent No.: US 8,151,836 B2
(45) Date of Patent: Apr. 10, 2012

(54) CLOSURE FOR A LIQUID CONTAINER

(75) Inventors: Philip Andrew Walton, Bishop Auckland (GB); Andrew Smith, Bishop Auckland (GB)

(73) Assignee: EBAC Limited, Bishop Auckland (GB)

( * ) Notice: Subject to any disclaimer, the term of this patent is extended or adjusted under 35 U.S.C. 154(b) by 1091 days.

(21) Appl. No.: 11/990,546

(22) PCT Filed: Aug. 22, 2006

(86) PCT No.: PCT/GB2006/003133
§ 371 (c)(1),
(2), (4) Date: Feb. 15, 2008

(87) PCT Pub. No.: WO2007/026122
PCT Pub. Date: Mar. 8, 2007

(65) Prior Publication Data

US 2009/0090690 A1 Apr. 9, 2009

(30) Foreign Application Priority Data

Aug. 27, 2005 (GB) ..... 0517545.0

(51) Int. Cl.
*B65B 1/04* (2006.01)
*B67D 7/06* (2010.01)

(52) U.S. Cl. ..... 141/291; 141/285; 141/363; 141/364; 141/365; 141/366; 222/185.1

(58) Field of Classification Search ..... 141/285, 141/291, 351, 363–366; 222/185.1
See application file for complete search history.

(56) References Cited

U.S. PATENT DOCUMENTS

| | | | | |
|---|---|---|---|---|
| 5,095,962 | A * | 3/1992 | Lloyd-Davies et al. | 141/346 |
| 5,392,939 | A | 2/1995 | Hidding | |
| 5,609,195 | A * | 3/1997 | Stricklin et al. | 141/346 |
| 5,647,416 | A | 7/1997 | Desrosiers | |
| 5,653,270 | A * | 8/1997 | Burrows | 141/18 |
| 6,193,113 | B1 * | 2/2001 | Hidding | 222/325 |
| 6,772,807 | B1 | 8/2004 | Tang | |
| 2006/0054243 | A1 | 3/2006 | Walton | |

OTHER PUBLICATIONS

International Search Report Nov. 20, 2006.

* cited by examiner

*Primary Examiner* — Timothy L Maust
(74) *Attorney, Agent, or Firm* — Ira S. Dorman

(57) ABSTRACT

A closure for the neck of a container such as a water bottle includes a cap 32 for engagement with the neck, and a valve plug 44. The cap has an inner guide sleeve 38 which sealingly receives the valve plug 44, which is provided with latches 50. When the bottle is placed on a liquid dispensing station such as a water cooler a probe 5 sealably enters the sleeve 38 and an actuator head 70 engages the latches 50 to carry the plug out of the sleeve 38. The probe requires minimum insertion force. One or more water flow ports 72 are provided in the probe 5 to conduct water out of the bottle, while air may enter the bottle via a vent port 73 and vent apertures in the valve plug 44. This allows simultaneous exchange of air and water without risk of air entrainment whilst providing a short penetration distance.

10 Claims, 4 Drawing Sheets

CLOSURE FOR A LIQUID CONTAINER

TECHNICAL FIELD OF THE INVENTION

This invention relates to a closure for a liquid container such as a water bottle, and a liquid dispensing station for use with containers provided with such a closure.

BACKGROUND

A common form of liquid dispensing station is a water cooler which dispenses water from an inverted bottle mounted on the water cooler. Water is normally removed from the bottle through a probe which may feed the ambient water to a reservoir provided with a cooling system, so that a supply of chilled water is available from a dispense valve when required.

In order to prevent spillage of water when the bottle is inverted, the bottle is generally provided with a cap which is normally sealed but which is capable of being opened when the inverted bottle is engaged with the probe. It is desirable that the cap is also self-sealing, so that spillages do not occur if the bottle is removed from the water cooler with liquid remaining in the bottle. It is known, for example from U.S. Pat. No. 4,991,635, to provide the cap with a sliding valve element which is held captive within the cap for operation by the probe. In early water coolers the probe only provided a single flow path through which water left the container. Air would periodically return along the same flow path from within the reservoir to replace the water removed from the bottle. The use of a sliding valve element is not detrimental when using such a single flow path, since the air and water travel alternately in pulses and will find their own way past any obstruction which may be presented by the valve components.

It has now become commonplace to provide a second flow path within the probe through which atmospheric air can enter the bottle through a separate vent port at the same time as water is leaving the bottle through the water flow path. This provides a smoother flow, reduces stresses within the bottle, and reduces turbulence within the cooling reservoir which could cause fluctuations in the temperature of the water being dispensed. Hygienic water coolers have a reservoir which is sealed to prevent atmospheric air from entering the reservoir, and clean atmospheric air is drawn directly into the probe without first passing through the reservoir.

In any water cooler having a probe with dual flow paths it is very desirable to prevent air from being entrained into the water which is simultaneously leaving the reservoir. In order to reduce this risk the vent port is positioned away from the water inlet ports.

In the vast majority of water bottles which are supplied at present, the bottle cap is provided with a frangible sealing plug which is broken away from the cap when the probe is inserted. The probe is designed to become frictionally engaged with the plug during insertion so that the plug may re-engage the cap to re-seal the bottle when the bottle is removed. This arrangement has the advantage that the air and water ports of the probe are held clear of the cap so that there is little risk of air entrainment, but there are a number of significant disadvantages. In some cases the plug may float free within the bottle instead of becoming engaged with the probe, which is disconcerting to the user and causes spillage if a partially full bottle is removed. In recent years there has been a trend towards the use of smaller and lighter bottles, which are now commonly thin-walled and moulded of plastics. As the size and weight of the bottle and its contents is reduced the user is often required to apply additional manual downward pressure on the bottle to release the sealing plug. Furthermore, with smaller bottles the insertion distance of the probe becomes more significant, and it is therefore desirable to reduce the penetration of the probe.

A first object of the present invention is to provide a new and inventive form of closure for a liquid container such as a water bottle which requires minimum force to unseal and re-seal the closure when the container is engaged with a probe, which is capable of reduced penetration distance without increasing the risk of air entrainment. An additional first object is to minimise the risk of components becoming free within the container and failing to re-seal when the container is removed.

A second object of the invention is to provide a new and inventive form of liquid dispensing station for use with such liquid containers which provides a smooth flow of air and liquid and contributes towards achieving a reduced penetration distance without increasing the risk of air entrainment.

SUMMARY OF THE INVENTION

The present invention provides a closure for a liquid container, the closure including:

- a guide defining a passageway for sealingly receiving a probe having a flow path for conducting liquid from the container and a separate flow path for conducting air into the container; and
- a valve member which is received in said guide in a sealing position wherein the valve member sealingly closes the passageway, and the valve member is provided with means for engaging the probe and is arranged such that the valve member is carried out of the guide by the probe upon movement of the probe through the passageway leaving a clear separation between the valve member and the guide, characterised in that the valve member has at least one vent aperture which is normally closed to the interior of the container when the valve member is in the sealing position, but when the valve member is engaged with the probe said vent aperture or apertures communicate with the air flow path to admit air into the interior of the container through said vent aperture or apertures whilst liquid simultaneously flows out of the container into the liquid flow path via said clearance between the valve member and the guide.

The invention also provides a liquid dispensing station which includes

- a receiver for receiving and supporting a liquid container having a closure with a valve member;
- a probe arranged for insertion into the closure when the liquid container is located on the receiver, the probe having an actuator head for engaging and operating the valve member, a flow path for conducting liquid from the container, and a separate flow path for conducting air into the container, and the probe has at least one liquid outlet port through which liquid may enter the liquid flow path from the container and at least one vent port through which air may leave the air flow path to enter the container;
- a reservoir for receiving liquid supplied from the container through the probe via said liquid flow path; and
- a dispense outlet for dispensing liquid from the reservoir;

characterised in that said at least one vent port is positioned in the actuator head to conduct air through the valve member into the container when the valve member is engaged with the actuator head.

BRIEF DESCRIPTION OF THE DRAWINGS

The following description and the accompanying drawings referred to therein are included by way of non-limiting example in order to illustrate how the invention may be put into practice. In the drawings.

DETAILED DESCRIPTION OF THE DRAWINGS

Figure 1:
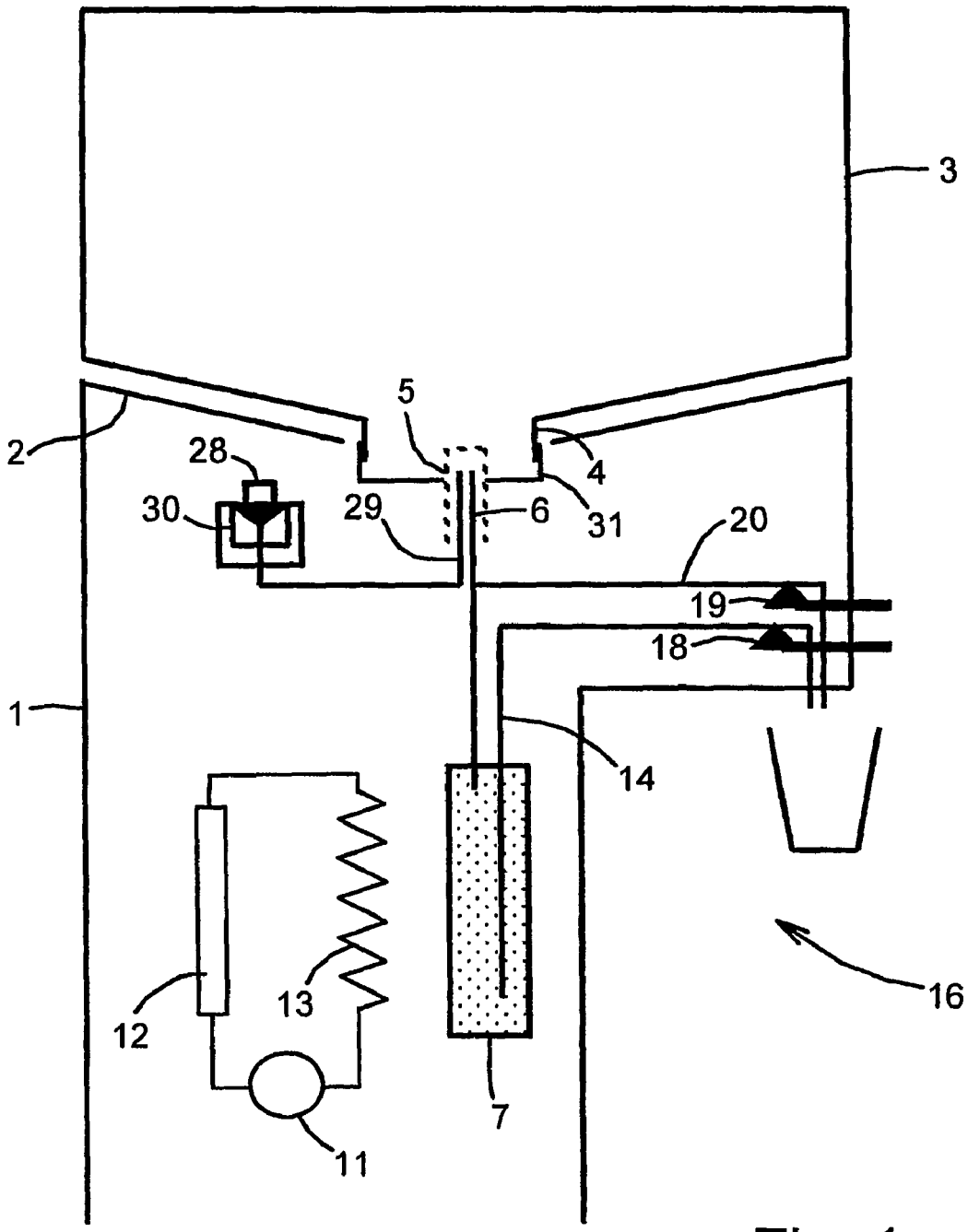
FIG. 1 is a schematic diagram showing the general layout of a preferred form of water cooler as used with a bottle having a closure in accordance with the invention.

FIG. 1 shows a liquid dispensing station of the kind which is generally referred to as a water cooler. The water cooler includes a housing 1 provided with a dish-like lid 2 forming a seat for a water bottle 3 which, in use, is mounted in an inverted position with its neck 4 inserted through an aperture in the lid 2. The neck of the bottle is provided with a closure 31, as described below. When the bottle is mounted on the seat 2, the closure becomes sealingly engaged with a probe 5 which is incorporated in a bottle connector. A water flow path 6 conducts liquid from the bottle through the probe 5 to a reservoir 7 mounted within the housing 1. Water contained within the reservoir 7 may be cooled by a refrigeration system which, in this example, includes a compressor 11, an air-cooled condenser 12 and an evaporator 13 mounted in close thermal contact with the reservoir 7. Chilled water is removed from the reservoir 7 via an outflow path 14 which terminates above a dispensing recess 16 formed in the housing 1. Flow control is achieved by means of a dispense valve 18 which may be arranged for direct manual operation or indirect manual operation via an electrical switch and a solenoid. An ambient water path 20 may travel directly from the water flow path 6 via a second dispense valve 19 to the dispensing recess 16, to provide a supply of water at room temperature. The water pathway from the bottle 3, through the probe 5, reservoir 7 and outflow path 14 is fully sealed to prevent contact with atmospheric air, as is the pathway from the probe 5 to the ambient water outlet. On initial use, gravity causes water to flow through the water pathways from the bottle 3 to the dispense outlets, and air is purged through the dispense outlets so that the water pathways become substantially filled with water. Water displaced from the bottle is replaced by air which enters the bottle through a microfilter 28 and an air flow path 29 which leads into the bottle through the probe 5 separately from the water flow path 6. A non-return valve 30 may be included in the air pathway to prevent leakage of water, e.g. due to expansion of air within the bottle.

Water could also be supplied from the water flow path 6 to a hot tank (not shown) to be heated and dispensed above ambient temperature through a separate outlet in the dispensing recess 16, for use in making hot beverages for example. In the form of water cooler described above, water is transferred from the bottle 3 to the discharge outlets by gravity. However, by including a pump-operated pressure-feed system the dispense outlets may be located in an elevated position relative to the neck of the bottle.

Figure 2:
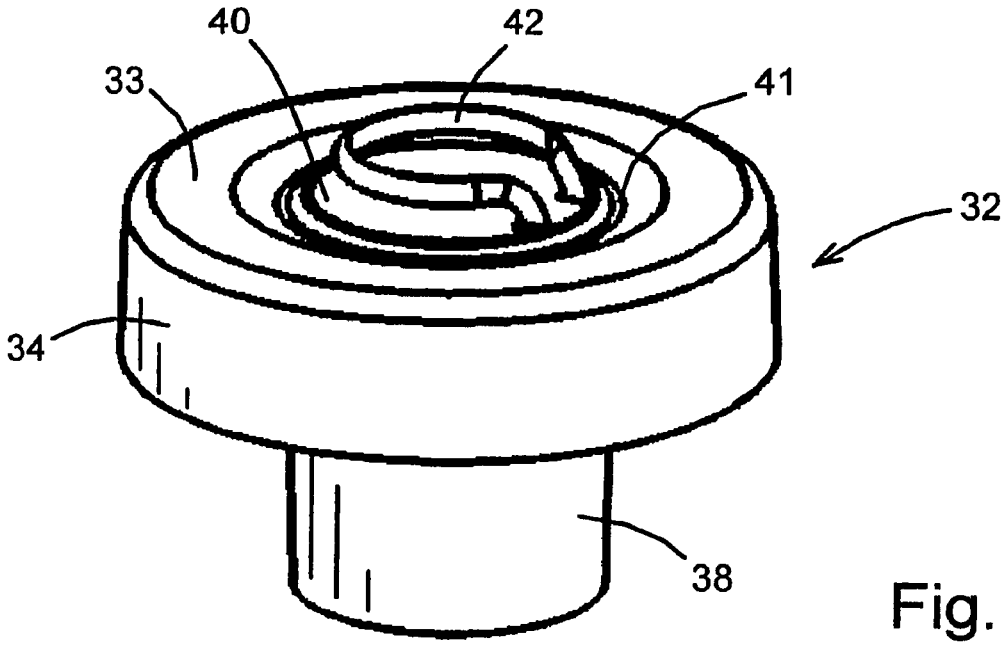
FIG. 2 is a general external view of a cap which forms the main component of the bottle closure, prior to mounting on the water cooler.
Figure 3:
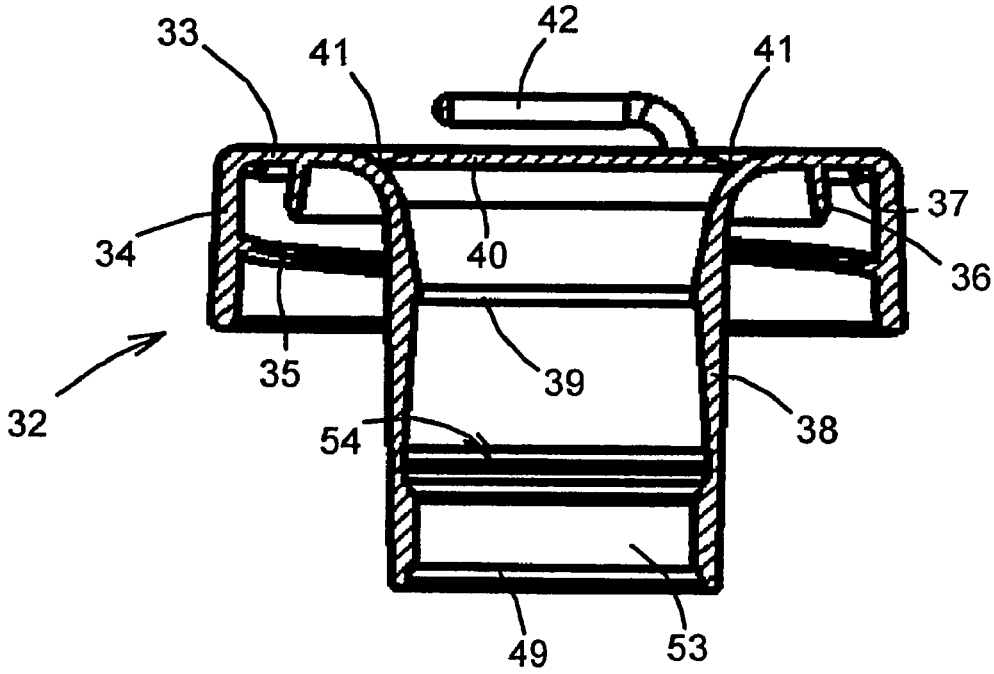
FIG. 3 is an axial section through the cap.

FIGS. 2 and 3 show a cap 32 which forms the main component of the closure 31 which is provided for closing and sealing the neck 4 of the bottle 3 to maintain the contents of the bottle in a clean and sanitary condition. The cap is shown in a position which it adopts when mounted on the bottle 3 before the bottle is inverted and mounted on the seat 2. The cap 32 is typically moulded from plastic and incorporates an annular end wall 33 and a peripheral, generally cylindrical skirt 34 which is adapted to surround and engage the neck of the bottle, for example by means of screw threads 35, a push fit, an external clamp or the like. A short, slightly flexible cylindrical wall 36 may depend from the end wall 33 to locate inside the neck of the bottle in use, a flexible seal 37 being formed between the skirt 34 and the wall 36 to form a seal with the neck. The cap also has a generally cylindrical inner guide sleeve 38 which projects from end wall 33 for insertion into the neck of the bottle, and which is dimensioned to receive and guide the probe 5 as a close sliding fit. The inner surface of the sleeve is provided with at least one annular sealing surface 39 to ensure that a tight water seal is maintained with the probe 5. When the cap is mounted on the neck of the filled bottle 3 prior to mounting on a water cooler, a primary seal is formed by a sealing disc 40 to prevent the contents from leaking through the guide sleeve 38. The disc is integrally joined to the annular end wall 33, at the junction with the sleeve 38, by a continuous but relatively thin peripheral web 41. An external pull ring 42 is integrally joined to the disc 40, adjacent to one edge of the disc, so that the ring normally lies parallel to the disc. Immediately before the bottle is inverted and mounted on the water cooler the ring 42 may be pulled to break the web 41 and tear the disc away from the cap, thereby opening the guide sleeve 38 for insertion of the probe 5. A tab or other gripping element could be used for the same purpose instead of a pull ring.

Figure 4:
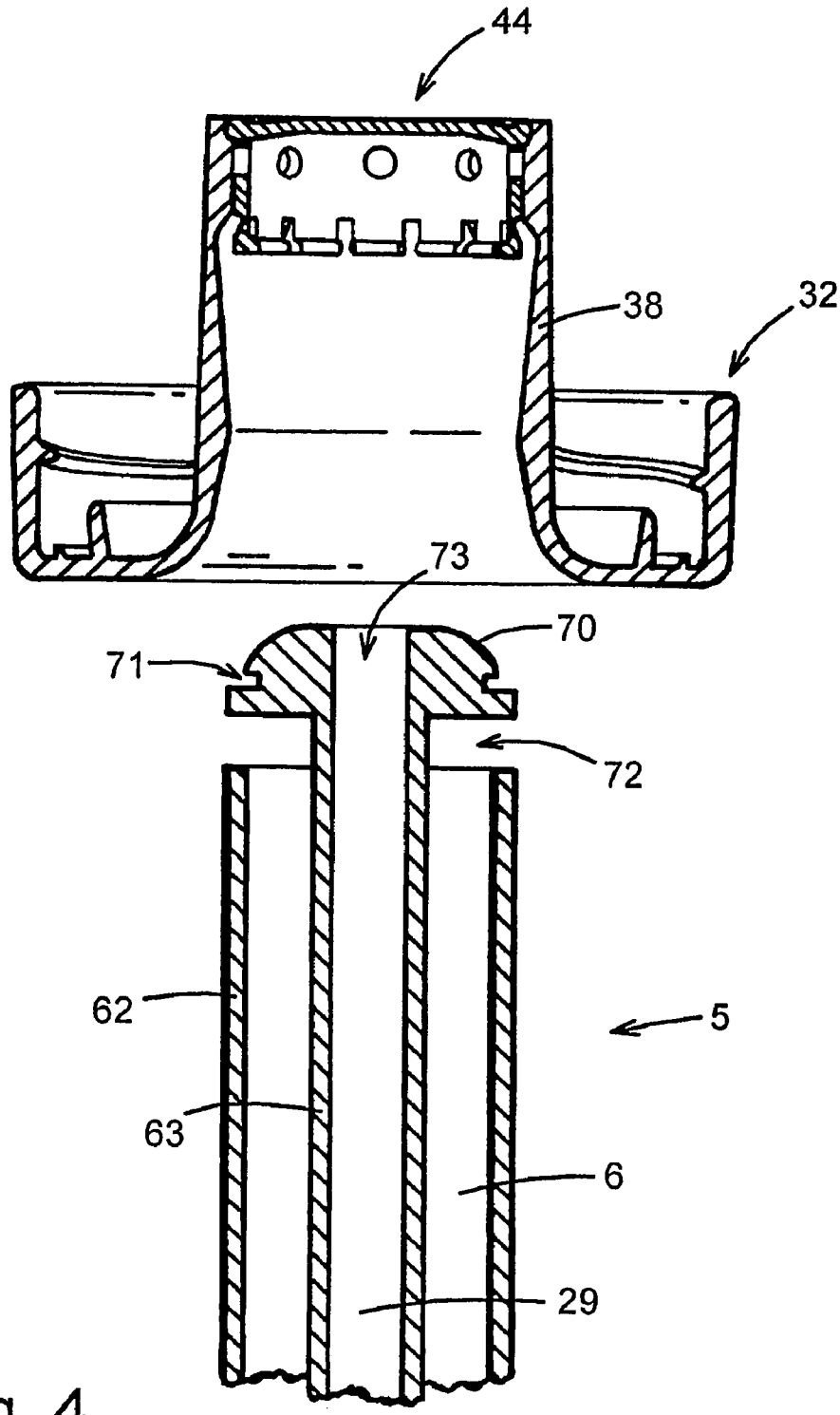
FIG. 4 is a longitudinal section through the bottle closure valve member, which in this case is shown in an inverted position ready for engagement with a probe of the water cooler.
Figure 5:
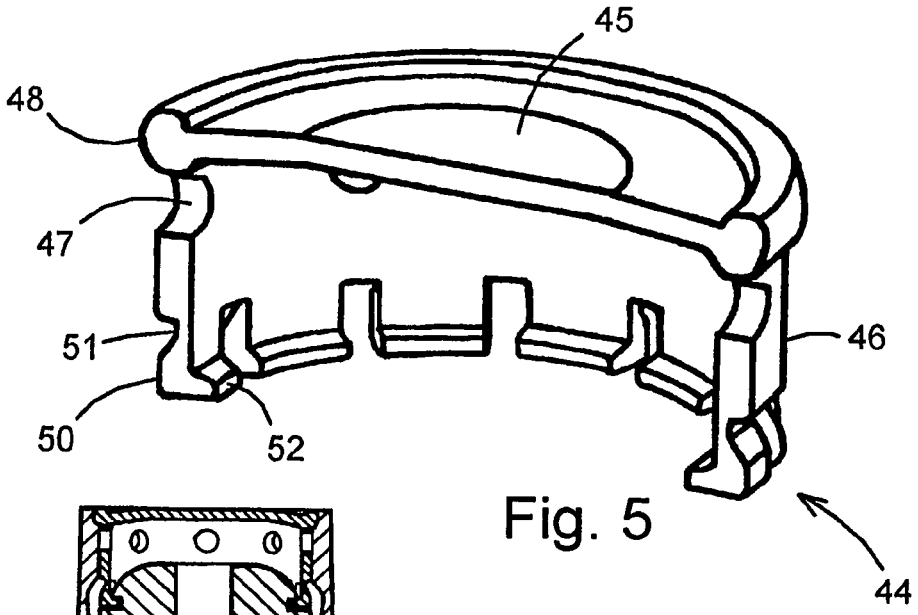
FIG. 5 is a general view of the sectioned valve member, shown separately.

Referring to FIG. 4, the closure 31 includes a valve member 44, which was omitted from the previous drawings for clarity. The valve member is a further plastics moulding, which is also shown separately in FIG. 5. The valve member 44 is sealingly engaged in the open free end of the guide sleeve 38, acting as a displaceable sealing plug to prevent loss of water through the guide sleeve after the primary seal formed by disc 40 has been removed. The valve member 44 is generally cup shaped, having a circular end wall 45 and a short generally cylindrical side wall 46 which contains a number of circumferentially-spaced vent apertures 47. Adjacent to the end wall 45, the side wall 46 has an external rib 48 which locates in a divergent outer end 49 of the sleeve 38 (FIG. 3) to limit insertion of the valve member into the sleeve. At the opposite end of the side wall 46, the valve member has a number of circumferentially-spaced, axially projecting latches 50 which are each joined to the wall 46 by means of slightly flexible hinge 51. Each latch 50 has an inwardly-directed latching tooth 52, the function of which will shortly be described. In the normal sealing position of the valve member 44, the vent apertures 47 are sealingly covered by a cylindrical inner surface 53 of the guide sleeve 38 (FIG. 3), and the latches are disposed opposite an annular recess 54 inside the sleeve 38.

Referring again to FIG. 4, the probe 5 has a cylindrical outer wall 62 which contains a concentric inner tube 63. At the upper end of the probe, the tube 63 projects above the outer wall 62 and is formed with a valve actuator head 70 which is of generally domed shape and of substantially the same outer diameter as the outer wall 62. The actuator head 70 is surrounded by a locking recess 71. The annular space between the wall 62 and tube 63 forms the water flow path 6 terminating in a water flow port 72 immediately below the actuator head 70, while the space within the tube 63 forms the air flow path 29, terminating at a vent port 73 at the top of the actuator head 70. The flow port 72 could, alternatively, be formed by a plurality of circumferentially spaced ports. Similarly, the vent port 73 could equally comprise a plurality of ports in the upper surface of the actuator head 70.

Figure 6:
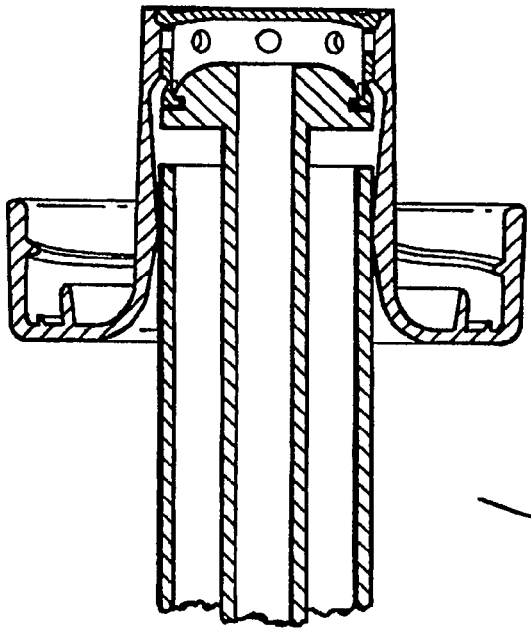
FIG. 6 is a further longitudinal section through the bottle closure, during the initial stages of engagement with a probe of the water cooler.
Figure 7:
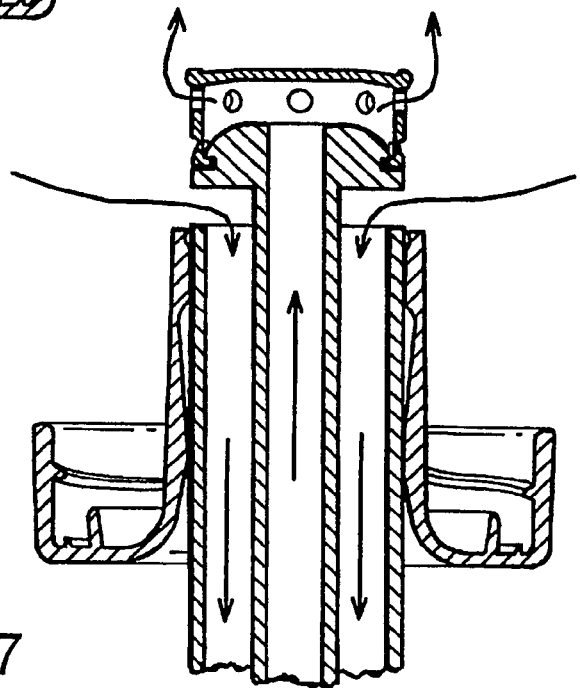
FIG. 7 is a similar view to FIG. 6 but showing the bottle closure fully engaged with the probe.

During lowering of the inverted bottle onto the water cooler, the probe 5 passes into the guide sleeve 38 and the outer probe wall 62 makes sealing contact with the internal sealing surface 39. Upon further insertion of the probe 5 (which in actual fact remains stationary) the head 70 makes contact with the latches 50, urging them to bend outwards into the annular recess 54. The frictional engagement of the valve plug 44 in the guide sleeve 38 is greater than the force required to bend latches 50 so that the valve member remains sealingly engaged in the sleeve 38. When the latch teeth 52 become aligned with the locking recess 71 the latches resiliently spring inwards so that the teeth become engaged in the locking recess, as shown in FIG. 6. Further downward movement of the cap causes the probe to carry the valve member 44 out of the guide sleeve 38, eventually reaching the position shown in FIG. 7, with the water flow port 72 disposed within the bottle clear of the sleeve 38. In this condition water can flow out of the bottle through the port 72 and pass into the flow path 6 within the probe 5 to travel to the reservoir, as described. Simultaneously, air may pass through the upper vent port 73 and enter the bottle through the valve member 44, exiting through the vent apertures 47.

The configuration of the probe 5 and valve member 44 ensures that there is little or no risk of air entrainment into the water flow path 6 whilst minimising the penetration distance of the probe 5. The air entering the bottle tends to rise upwards in streams of small bubbles whereas water tends to be drawn in from the lowermost regions of the bottle.

While the probe 5 remains inserted into the bottle the latches 50 remain firmly engaged with the actuator head 70. When the bottle is removed from the water cooler and withdrawn from the probe 5 the valve member 44 is drawn back down the guide sleeve 38, the divergent end 49 ensuring that the latches smoothly enter the sleeve. Once inside the sleeve, the latches cannot disengage from the actuator head until they come to lie opposite the recess 54, in which position the valve member 44 is returned to its sealing position to prevent leakage from the bottle. Further upward movement of the bottle causes the actuator head 70 to urge the latches 50 in a radially outward direction so that the probe may be fully withdraw from the closure.

The latching action described provides positive engagement and disengagement of the valve member with the probe, although the valve member could engage the actuator head by other means, e.g. frictional engagement produced by simple radial expansion.

It will be appreciated that the features disclosed herein may be present in any feasible combination. Whilst the above description lays emphasis on those areas which, in combination, are believed to be new, protection is claimed for any inventive combination of the features disclosed herein.

The invention claimed is:

1. A closure for a liquid container, the closure including:

a guide (38) defining a passageway for sealingly receiving a probe (5) having a flow path (6) for conducting liquid from the container (3) and a separate flow path (29) for conducting air into the container; and a valve member (44) which is received in said guide in a sealing position wherein the valve member sealingly closes the passageway, and the valve member is provided with means (52) for engaging the probe and is arranged such that the valve member is carried out of the guide by the probe upon movement of the probe through the passageway leaving a clear separation between the valve member and the guide, characterized in that the valve member (44) has at least one vent aperture (47) which is normally closed to the interior of the container when the valve member is in the sealing position, but when the valve member is engaged with the probe said vent aperture or apertures communicate with the air flow path (29) to admit air into the interior of the container through said vent aperture or apertures whilst liquid simultaneously flows out of the container into the liquid flow path (6) via said clearance between the valve member and the guide.

2. A closure according to claim 1 in which said means for engaging the probe includes at least three latch elements (52) which are operable to engage the probe.

3. A closure according to claim 2 in which the latch elements (52) are resiliently held in a probe-engaging position.

4. A closure according to claim 2 or 3 in which, when the valve member (44) is in its sealing position, the latch elements (52) are aligned with a recess (54) in the wall of the guide which allows said latch elements to move outwardly for engagement with and disengagement from the probe (5).

5. A closure according to claim 1 in which the valve member (44) is substantially cup shaped having an end wall (45) and a side wall (46) and said vent aperture or apertures (47) are formed in said side wall.

6. A closure according to claim 1 which includes an integral sealing element (40) which is joined to the guide by a continuous frangible web (41), the sealing element having projecting gripping means (42) for pulling the sealing element to break the seal and tear the element away from the guide.

7. A closure according to claim 6 in which the projecting gripping means is a pull ring (42) which is integrally joined to the sealing element (40) adjacent to one edge thereof.

8. A closure according to claim 1 for use with a liquid container (3) having a neck (4) with an opening, the closure including an end wall (33) provided with means (37) for sealing engagement with the container neck, and said guide (38) projects from the end wall to extend into the container neck.

9. A liquid dispensing station which includes:

a receiver (2) for receiving and supporting a liquid container (3) having a closure (31) with a valve member (44);

a probe (5) arranged for insertion into the closure when the liquid container is located on the receiver, the probe having an actuator head (70) for engaging and operating the valve member, a flow path (6) for conducting liquid from the container, and a separate flow path (29) for conducting air into the container, and the probe has at least one liquid outlet port (72) through which liquid may enter the liquid flow path from the container and at least one vent port (73) through which air may leave the air flow path to enter the container;

a reservoir (7) for receiving liquid supplied from the container through the probe via said liquid flow path (6); and a dispense outlet (18) for dispensing liquid from the reservoir;

characterized characterised in that said at least one vent port (73) is positioned in the actuator head (70) to conduct air through the valve member (44) into the container when the valve member is engaged with the actuator head, and in that said air flow path (29) for conducting air into the container is arranged to receive atmospheric air without passing through the reservoir (7).

10. A liquid dispensing station which includes:

a liquid container (3) having a closure (31) with a valve member (44);

a receiver (2) for receiving and supporting said liquid container (3);

a probe (5) arranged for insertion into the closure when the liquid container is located on the receiver, the probe having an actuator head (70) for engaging and operating the valve member, a flow path (6) for conducting liquid from the container, and a separate flow path (29) for conducting air into the container, and the probe has at least one liquid outlet port (72) through which liquid may enter the liquid flow path from the container and at least one vent port (73) through which air may leave the air flow path to enter the container;

a reservoir (7) for receiving liquid supplied from the container through the probe via said liquid flow path (6); and a dispense outlet (18) for dispensing liquid from the reservoir;

in which said at least one vent port (73) is positioned in the actuator head (70) to conduct air through the valve member (44) into the container when the valve member is engaged with the actuator head;

said closure includes a guide (38) defining a passageway for sealingly receiving said probe (5);

said valve member (44) is received in said guide in a sealing position wherein the valve member sealingly closes the passageway;

the valve member is provided with means (52) for engaging the probe and is arranged such that the valve member is carried out of the guide by the probe upon movement of the probe through the passageway leaving a clear separation between the valve member and the guide; and the valve member (44) has at least one vent aperture (47) which is normally closed to the interior of the container when the valve member is in the sealing position, but when the valve member is engaged with the probe said vent aperture or apertures communicate with the air flow path (29) to admit air into the interior of the container through said vent aperture or apertures whilst liquid simultaneously flows out of the container into the liquid flow path (6) via said clearance between the valve member and the guide.

* * * * *